US006086271A

United States Patent [19]

DeBernardi

[11] Patent Number: 6,086,271

[45] Date of Patent: Jul. 11, 2000

[54] PHOTOGRAPHIC MATERIAL GRASPING AND DRAGGING DEVICE FOR PHOTOGRAPHIC MATERIAL DEVELOPING MACHINES, IN PARTICULAR OF PHOTOGRAPHIC PAPER

[76] Inventor: Ernesto DeBernardi, Via Spilimbergo 7, 33170 Pordenone, Italy

[21] Appl. No.: 09/047,091

[22] Filed: Mar. 24, 1998

[30] Foreign Application Priority Data

Mar. 24, 1997 [IT] Italy ..... PN97A0015

[51] Int. Cl.[7] ..... G03D 13/10; G03D 3/08; B65H 17/34

[52] U.S. Cl. ..... 396/653; 396/622; 226/173; 226/92

[58] Field of Search ..... 396/618, 622, 396/647, 649, 650, 651, 652, 653, 620; 226/92, 173

[56] References Cited

U.S. PATENT DOCUMENTS

| | | | |
|---|---|---|---|
| 4,072,260 | 2/1978 | Dove | 396/652 |
| 4,188,108 | 2/1980 | Falomo | 396/652 |
| 4,576,321 | 3/1986 | Marson | 396/612 |
| 4,821,060 | 4/1989 | Kurths | 396/652 |

*Primary Examiner*—Alan A. Mathews
*Attorney, Agent, or Firm*—Bucknam and Archer

[57] ABSTRACT

Photographic material grasping and dragging device for photographic material developing machine, in particular of photographic paper, shaped as a fork provided with a first and a second portion (26, 27) respectively for the photographic material winding and for the hooking and unhooking with respect to the guide band (leader) of the machine. Device which comprises clamping means (grasping jaws 32) co-operating with the guide band (28) and sprung articulated means (31) adapted to drive the clamping means (32) from a first to a second operative position, in which they are respectively disengaged and engaged with respect to the guide band (28), and vice versa. Device which assures always a feed of photographic material at any operative condition and mechanical stress exerted by such material on the device referred to.

4 Claims, 7 Drawing Sheets

PHOTOGRAPHIC MATERIAL GRASPING AND DRAGGING DEVICE FOR PHOTOGRAPHIC MATERIAL DEVELOPING MACHINES, IN PARTICULAR OF PHOTOGRAPHIC PAPER

FIELD OF THE INVENTION

The invention relates to a photographic material grasping and dragging device for photographic material developing machines (film or paper), in particular of photographic paper, adapted to hook and unhook such material in a simple, quick, manual and/or automatic manner in order to permit it to pass and to be automatically developed through these machines.

BACKGROUND OF THE PRIOR ART

It is known that, the present photographic material developing machines and in particular of photographic paper which can be utilized in the developing and printing laboratories of large quantities of paper with different sizes and lenght, are substantially formed by a plurality of treatment tanks containing the different liquid chemical substances which are necessary to develop such photographic papers, as well as by drying units of the developed papers and by collecting containers of the developed and dried papers.

Such tanks and drying units are provided with motorized mechanical members fit to produce the unidirectional transport and feed of the phototographic paper, which is wound on a dispenser reel and placed in the loading area of the relative machine and is unwound progressively by the same and wound on a winding reel placed in the unloading area of the machine, as well as with at least a separate guide band (so called "leader"), driven by the machine motor unit and sliding into a position adjacent and parallel to the paper feed way, which band is hooked in advance on the initial zone of the paper through a grasping and dragging device (so called "pliers"), in order to produce the feed of this paper through all the developing machine. To this aim, the grasping and dragging device is substantially formed by a thin metallic plane and an extended fork, subdivided in a first portion for the winding of the photographic paper and a second portion for the hooking and the unhooking with respect to the band guide, said first portion being inserted in a correspondent groove of a cylindrical covering element, in order to produce a thin free gap between the same element and the two surfaces of the same portion, so that to insert the initial zone of the photographic paper to be dragged through the machine therein, and said second portion being provided with a bent free end portion and a torsion spring in a position opposed and spaced with respect to this bent end portion, in such a manner that the guide band can be inserted between said bent end portion and said spring, by moving this latter firstly in an opening position and then by letting it come back to its closing position in which it places itself elastically against said guide band, thereby maintaining it clamped between the same spring and the bent end portion, so that it permits to realize the dragging of the photographic paper. This fork is applied in advance on the loading area of the machine, by hooking for the sake its second portion on the guide band by operating manually on the torsion spring and by inserting the photographic paper initial zone on the first portion of said fork in the manner described above, with consequent progressive feed of the fork and of the photographic paper through all the machine. As soon as these elements arrive in correspondence at the unloading area of the same machine, the fork is unhooked automatically from the guide band through the action of an unhooking element which is wedge-shaped and applied to the machine in a position correspondent to that of the same band, in order to permit again the hooking of such fork on the initial zone of a subsequent photographic paper reel to be developed in the same manner described, while in its turn the developed photographic paper is completely wound on the relative winding reel and consequentely it can be drawn and prepared for the delivery to the customers. In practice, however, it has been found that this grasping and dragging device is critical when the photographic paper is subjected to mechanical stresses which exceed determinate values, circumstances in which the fork tends to inflect with respect to its right working position almost orthogonal with respect to the paper and guide band feed way, with consequent high stresses exerted by the same with respect to the guide band which also can produce an undesidered unhooking of such fork from said band, thereby interrupting the dragging of the photographic paper through the machine and compromising the right developing.

SUMMARY OF THE INVENTION

The present invention has the object to provide for a guide and dragging device of the kind and for the sake referred to, in which the inconvenience of the presently used device is eliminated, and which also assures a sure and reliable operation at any machine operative state.

This grasping and dragging device is made with the constructive characteristics substantially described. The invention will be better understood from the following description, given solely by way of a non-limiting example, and with reference to the enclosed drawings, in which:

Figure 1:
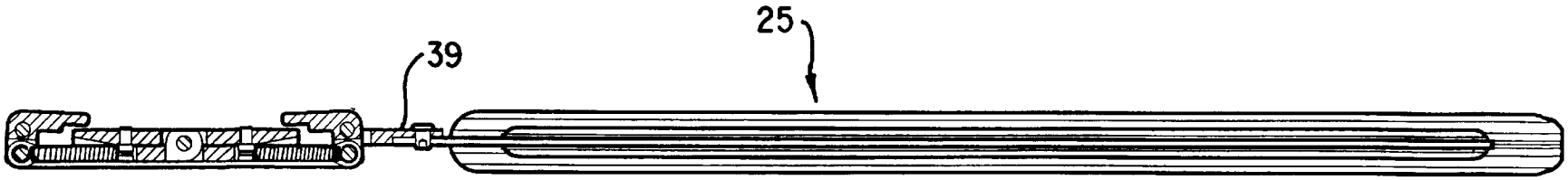
FIGS. 1, 2 and 3 show respectively a side, a plan and a front view of the grasping and dragging device according to the invention in a first embodiment.
Figure 2:
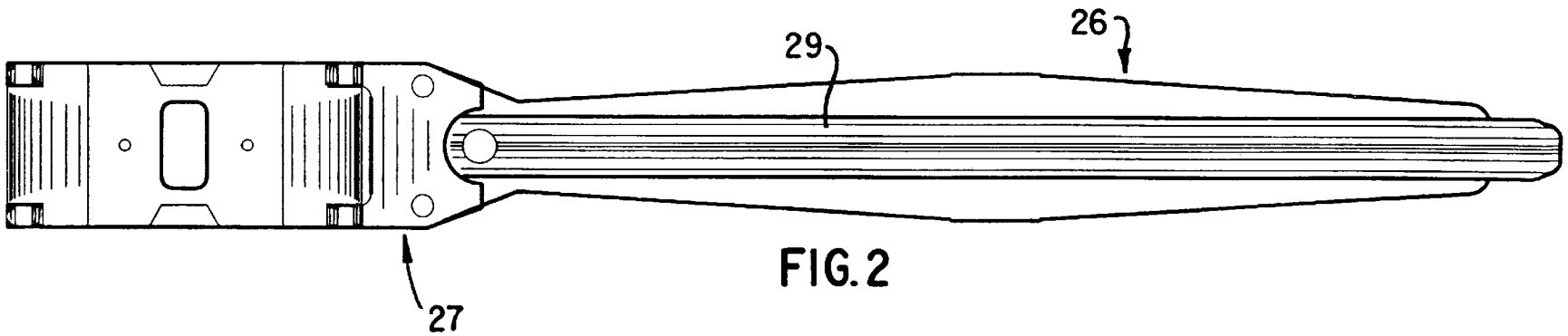
Figure 3:
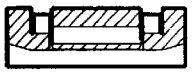
Figure 4:
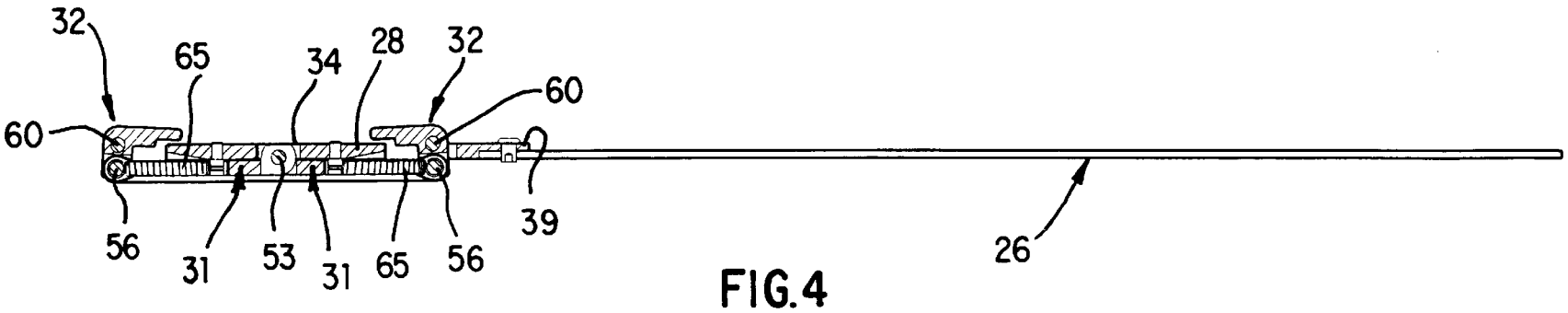
FIGS. 4 and 5 show a side view of the present device moved in two different operative positions.

In the Figures referred to it is illustrated schematically a grasping and dragging device according to the invention, adapted to be assembled in a traditional photographic material developing machine (film and paper), and in particular of photographic paper, in order to produce the dragging and the passing of this material through the developing machine and its consequent developing. With reference to the FIGS. 1, 2 and 3 in which the present grasping and dragging device is shown in a first embodiment, it is noted that it is substantially constituted by a thin plane and elongated metallic fork 25, subdivided in a first portion 26 for the winding of the photographic material (not shown) and a second portion 27 for hooking and unhooking with respect to a correspondent guide band (so called "leader", marked with the reference numeral 28 in the FIGS. 4 and 5) provided in the developig machine, in a position adjacent and parallel to the photographic material feed way and driven by the motor unit (not shown) of the same machine, in order to produce as usual the dragging of such fork and of the photographic material.

Also in this case, the first portion of the fork 26 is inserted in a correspondent groove (not shown) of a cylindrical covering element 29 secured to the same, thereby defining a thin free gap (not shown) between such covering element and the two surfaces of said fork portion, so that to be able to insert the initial zone of photographic material to be dragged through the machine, which material is wound for the sake as usual on a dispenser reel (not shown) placed in the machine loading area and is unwound progressively from such reel and wound on a winding reel placed in the machine unloading area, with feed produced by suitable motorized mechanical members of the same machine.

Figure 8:
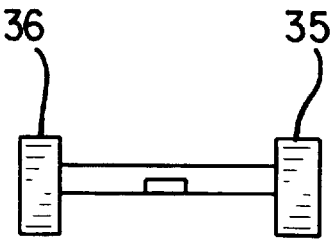
FIGS. 6, 7 and 8 show respectively a side, a plan and a front view of a constructive item of the present device.
Figure 6:
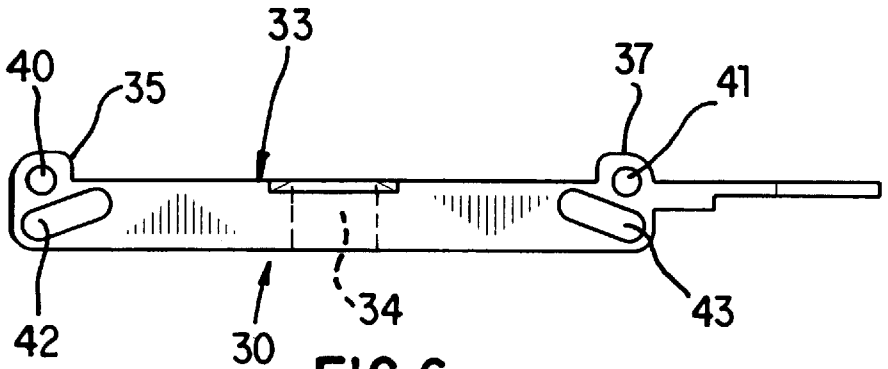
Figure 7:
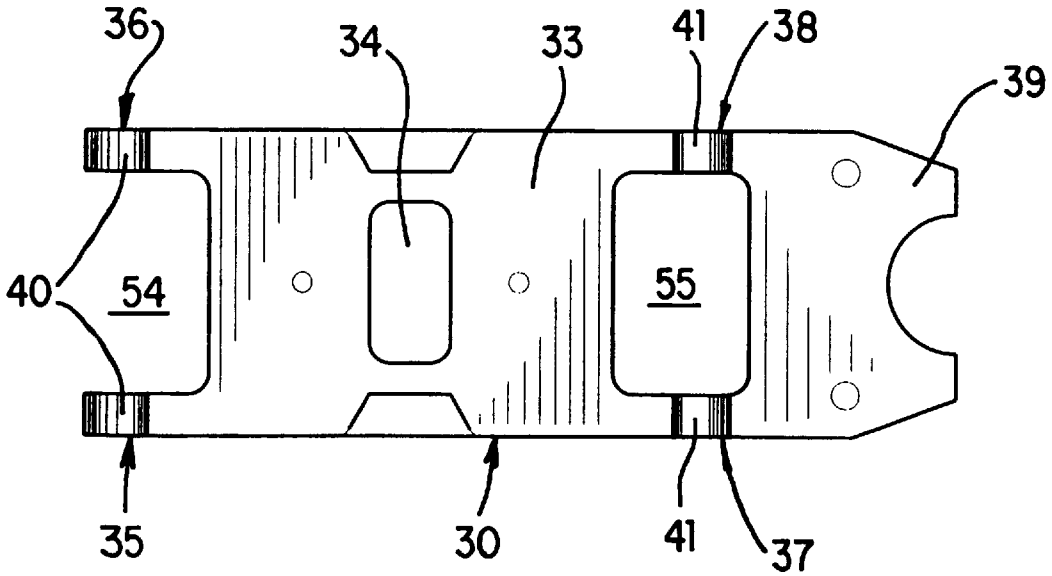
Figure 9:
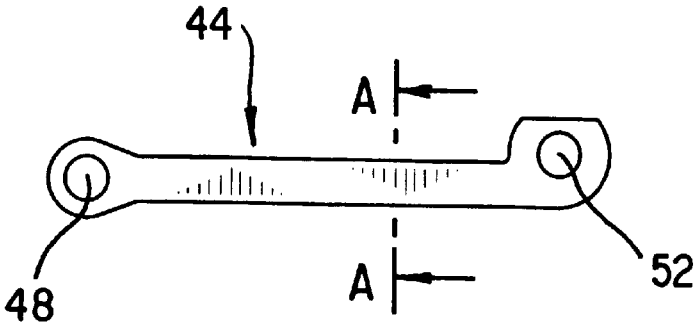
FIGS. 9, 10 and 11 show respectively a side, a plan and a cutaway front view of a further constructive item of the present device.
Figure 10:
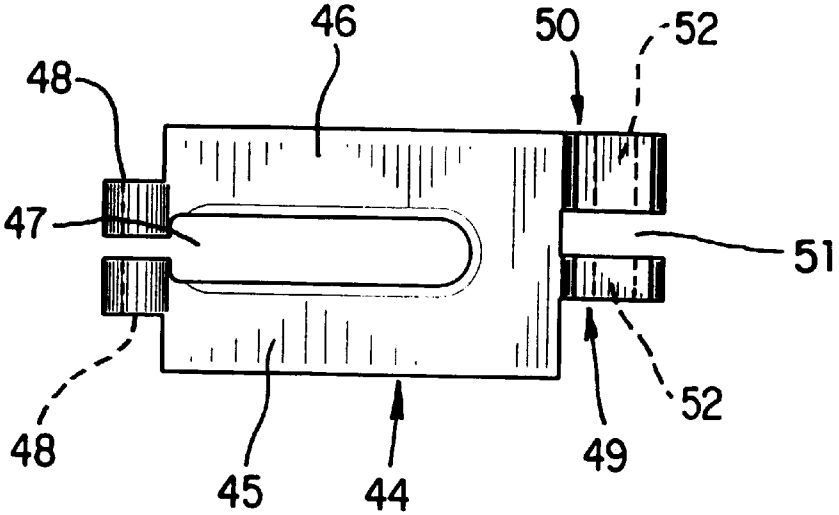
Figure 11:
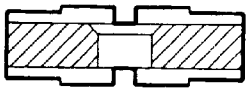
Figure 16:
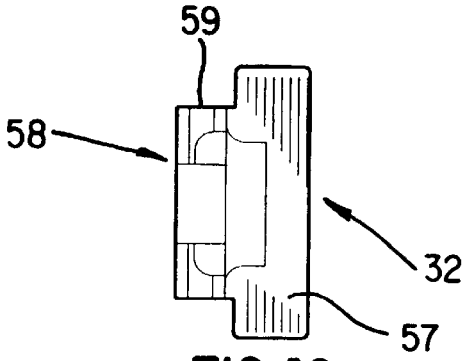
FIGS. 12, 13, 14, 15 and 16 show respectively a side, a plan, a back, a front view and a view from below of a further constructive item of the present device.
Figure 15:
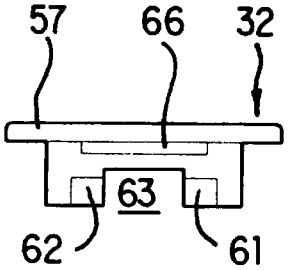
Figure 12:
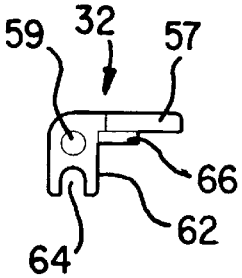
Figure 14:
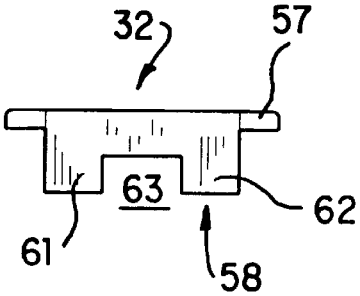
Figure 13:
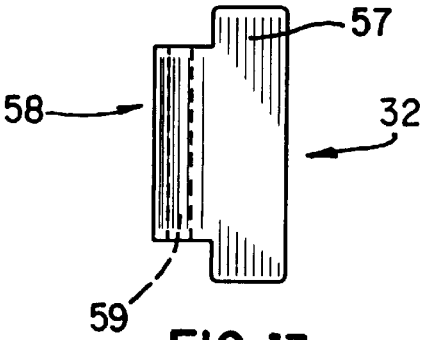

In its turn, the second fork portion 27 is substantially constituted by a set of different component parts joined reciprocally, that is a first component part shaped as a thin plate body 30, a second component part formed by two toggle joints 31 identical and articulated to each other as it will be described, and a third component part formed by at least two grasping jaws 32 identical to each other and destined to grasp the edges of the guide band 28 for hooking the fork 25 on the same. In particular, by reference also to the FIGS. 6–8, the first component part 30 comprises a central plane portion 33 having quadrangular shape in the central zone of which it is obtained a through opening 34 also having quadrangular shape, and the end portions of which extend in equal manner outwards, thereby defining the side projecting parts 35, 36 and 37, 38 having reduced thickness, their latter parts extend with a further plane portion 39 which is superimposed on and secured to the fork portion 26, said projecting parts being thickened and provided respectively with an upper through hole 40 and 41 and a through slot 42 and 43 situated below the associated through hole, which cross such parts transversally. In its turn, every toggle joint 31, which can be seen in the FIGS. 9–11, is formed by a plane plate 45 fork shaped with both its end portions, thereby defining from a side two extended arms 45 and 46 parallel and separated to each other by a slot 47, for the purpose hereinafter described, which arms are provided at their terminal zone with a correspondent transversal through hole 48, and from the other side two short arms 49 and 50 parallel and separated from each other by a slot 51, having a width slightly greater than that of every arm, which arms are offset with respect to the preceding arms and provided with a correspondent transversal through hole 52 at their terminal zone. In this way, such toggle joints 31 are joined reciprocally by aligning the relative short arms 49 and 50 in a way that these are put side by side to each other and are inserted in the correspondent slots 51, thereby aligning also all the through holes 52 of said arms, through which it is successively inserted an elongated pin 53 providing for the reciprocal articulation of the joints referred to, and moreover they are joined with the plate body 30 of the first component part with their extended arms 45 and 46, by arranging for the purpose the latter in the correspondent gaps 54 and 55 defined among the respective pairs of projecting parts 35, 36 and 37, 38, so that all the through holes 48 of said extended arms are aligned to each other and with the correspondent through slot 42 and 43, for the subsequent passing of an extended pin 56 providing for the articulation of every joint with said plate body therethrough. Finally, every grasping jaw 32, evident in the FIGS. 12–16, is formed by a part shaped with two plane portions 57 and 58 orthogonal to each other, of which the portion 57 is used for being clamped or not clamped against the guide band 28, thereby providing for the hooking and unhooking of the present grasping and dragging device with respect to the same band, and the portion 58, narrower than the precedent one, is provided with a transversal through hole 59 for all its breadth, of such size that it is able to receive a further articulation pin 60 which can be inserted in the through hole 40 and 41 of the plate body 30, and is shaped at is lower portion with two short projecting shanks 61 and 62, spaced away by a gap 63, and provided at their lower portion with a relative semicircular opened cavity 64 adapted to be lodged on the articulation pin 56 described above.

Figure 5:
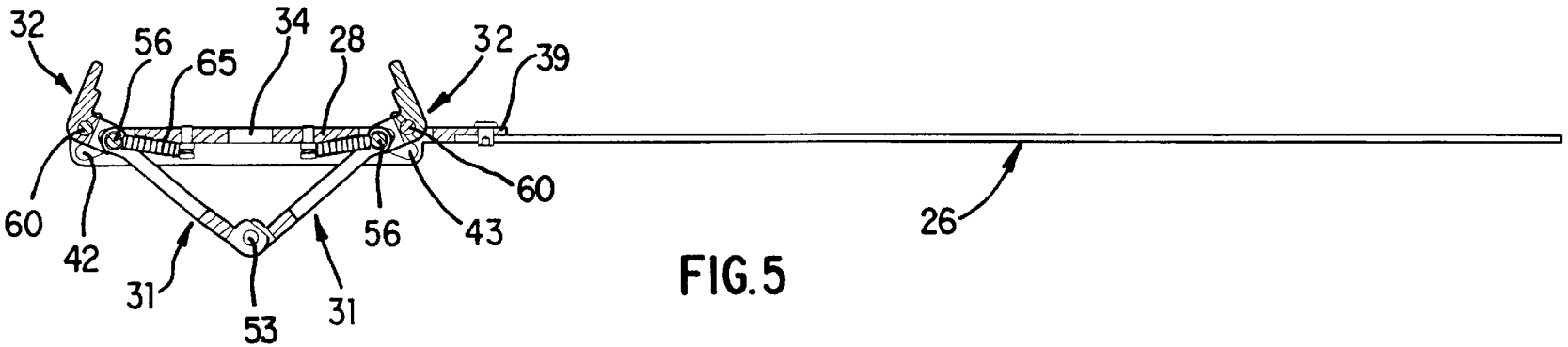

Moreover, these grasping jaws are made of such size that they adapt themselves in the correspondent lodging gap 54 and 55 of the plate body 30, and are assembled with the remaining component parts of the present grasping and dragging device by inserting every pin 60 through the through holes 40 and 41 of said plate body and the coincident through holes 59 of every jaw, and by inserting the semicircular cavity 64 on the correspondent articulation pin 56 of the toggle joints 31, and by connecting finally a set of draw springs 65 among the respective articulation pins 56 of every toggle joint and the plate body 30, upon lodging of such springs in the correspondent slots 47 of said extended arms, said springs being adapted to stress the toggle joints in a rest position shown in FIG. 5, in which they are reciprocally wide apart. It is so evident that the moving of the toggle joints 31 produces also the moving of the grasping jaws 32, thanks to the fact of being pivoted permanentely on two different points, on a first point with the plate body 30, through the pin 60, and on a second point with the toggle joints 31 through the pin 56. In particular, such toggle joints 31 can be moved easily and quickly from their initial rest position of FIG. 5, in which they are situated on their lowest point thanks to the sliding of the pins 56 into the relative slot 42 and 43 on a position brought closer to each other, with consequent rotation of the grasping jaws 32 on the relative pins 60 so as to assume a position reciprocally wide apart, in which the guide band 28 can be freely inserted between the jaws and hooked by the same, to their terminal operating position of FIG. 4 in which they are moved in their highest point, in which it is exceeded the dead center and consequently the elastic action of the springs 65 keeps them permanently in this position, in which the assembly short arms 49, 50-pin 53 passes through the through opening 34 of the plate body 30 by projecting slightly beyond the upper surface of this latter, with consequent sliding of the pins 56 into the relative slot 42 and 43 in a position reciprocally moved away and rotation of the grasping jaws 32 on the relative pins 60 so as to assume a position reciprocally brought closer, in which they are clamped on the guide band 28 by keeping it firmly in this position, without possibility of the displacement thereof whichever stress is exerted on to such guide band by the photographic material.

Figure 20:
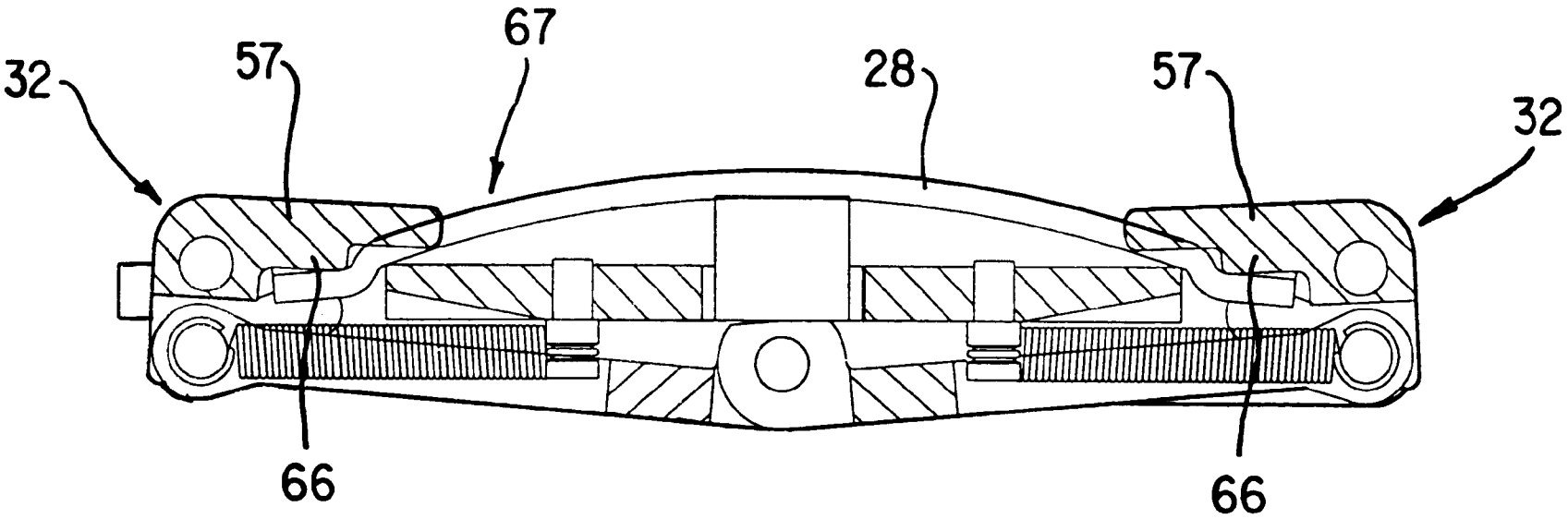
FIG. 20 shows a side view of the present device in a closing position, in order to show the hooking manner of the same on the developing machine guide band.

Moreover, in this band hooking position as evident in the FIG. 20, the band is clamped both by the plane portion 57 of every jaw 32 and a further plane portion 66 situated below it, having reduced size, thereby defining a winding way marked with the reference numeral 67, which assures a non-disjoinable engagement of the present grasping and dragging device with respect to the same band, and therefore prevents any casual extraction among these parts.

The so realized grasping and dragging device is hooked as described to both the guide band 28 and the photographic material on the developing machine loading area, thereby producing the feed of the same device and of the photographic material through the machine and the consequent developing of such photographic material.

Figure 21:
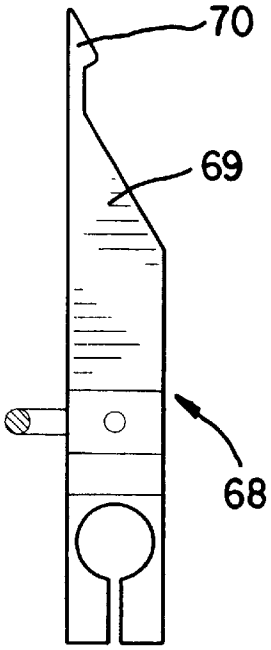
FIG. 21 shows a side view of an unhooking element applied to the developing machine and co-operating with the device according to the invention.

Moreover, on the machine unloading area it is applied an unhooking element 68 of traditional kind, which is represented in the FIG. 21, on a position correspondent to that of feeding of the guide band 28 and the second fork portion 27, said element comprising as usual an extended plane fork 69 provided with a head 70 with wedge beveled surface, which during the passing of the present grasping and dragging device acts with a sliding contact against the upper surface of the plate body 30 and therefore also against the assembly short arms 49, 50-pin 53, thereby producing the displacement of such assembly downwards so that, as soon as the dead center of the toggle joints 31 is exceeded, these latter are urged by the springs 65 on their rest position, and the consequent displacement of the jaws 32 in the wide apart position produces the automatic unhooking of the present device from said guide band, so that this grasping and dragging device can be utilized for a subsequent machine developing cycle with the same principles previously described.

Figure 17:
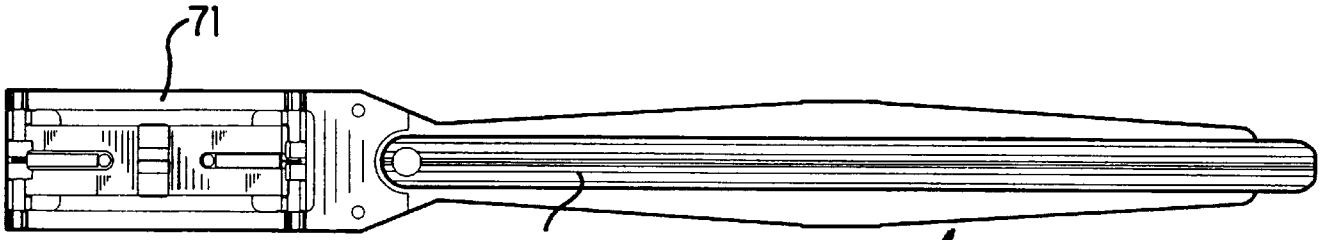
FIGS. 17 and 18 show respectively a plan and a front view of the grasping and dragging device in a second embodiment.
Figure 19:
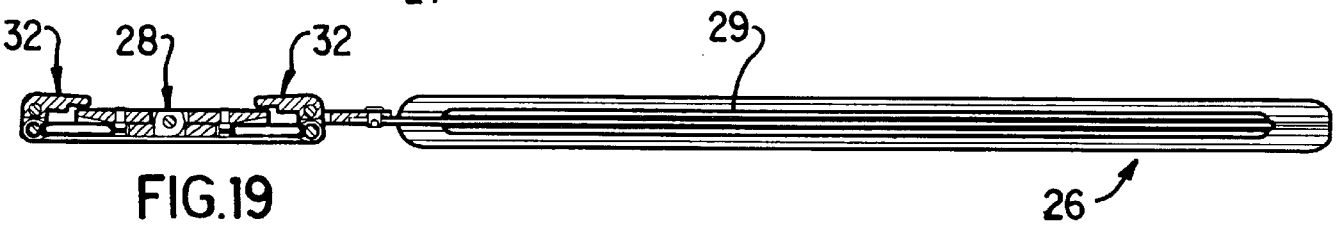
FIG. 19 shows a side view of the device of the FIGS. 17 and 18.
Figure 18:
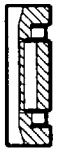

Finally, in the FIGS. 17, 18 and 19 it is represented the device according to the invention on its second embodiment, in which it is noted that also in this case the device is made with the same component parts described above, which are marked again with the same reference numerals, with the exception of the fact that the upper surface of the plate body 30 is provided with a transversal cavity 71 in correspondence of the through opening 34 of the same plate body, which is used as a guide for the head 70 of the unhooking element 68 in order to assure always the unhooking of the present device with the manners previously described. The device according to the invention, therefore, is capable of permitting the safe and reliable dragging of the photographic material at any operative condition and stress exerted thereon by such material, thereby preventing any undesidered risk of unhooking of the same device from the guide band and dragging interruption of this photographic material through the developing machine.

What is claimed is:

1. In a photographic developing machine having an initial loading area, a terminal unloading area and having a guide band (28), a grasping and dragging device for photographic paper, adapted to produce the dragging of said photographic paper through the machine for its developing, the device sliding from said initial loading area to said terminal unloading area, said device being shaped as a fork (25) provided with a first portion (26) and a second portion (27) respectively for the winding of said photographic paper and for the hooking and unhooking with respect to said guide band (28), carried out respectively in the machine loading and unloading area, through at least an unhooking element (68), wherein said second portion (27) comprises clamping means (32) co-operating with said guide band (28) and sprung articulated means (31), adapted to drive said clamping means (32) from a first to a second operative position, in which they are respectively disengaged and engaged with respect to said guide band (28), and vice versa, wherein said clamping means comprise a first and a second grasping jaw (32) placed laterally to said guide band (28) and articulated on a plate body (30) secured to said fork portion (26), each one of said first and second grasping jaws (32) comprise a first and a second planar part (57, 58) which are orthogonal to each other, said first part (57) being adapted to be engaged or disengaged with respect to said guide band (28) and said second part (58) being provided with at least a transversal through hole (59) and a lower opened cavity (64).

2. The device according to claim 1, which comprises a plate body (30) comprising a central planar portion (33) provided with a central through opening (34), and a first and second pair of side projecting parts (35, 36, 37, 38), respectively provided with at least a through hole (40, 41), for the passing of a first articulation pin (60) and an underlying through slot (42, 43).

3. A device according to claim 2, wherein said sprung articulated means comprise a first and a second toggle joint (31) formed by a respective planar plate (44) fork shaped and provided at their end portions with transversal through holes (52,48) for the passing of a second and a third pin (53,56) for the articulation of said toggle joints to each other at one end portion and with said slot (42, 43) at the other end portion thereof, with insertion of said lower opened cavity (64) on to said third pin (56), said toggle joints (31) being stressed by corresponding draw springs (65), secured between the corresponding third pin (56) and said plate body (30) to move from a first rest position in which they are positioned in their lowest point, in which said jaws (32) are displaced on their disengaged position, to a second working position in which they are moved to the highest point by penetrating with their articulated end portions and with the relative second articulated pin (53) into said through opening (34), in which said jaws (32) are displaced in the disengaged position, said toggle joints (31) being adapted to be returned back again from said second to said first operative position through the action of said unhooking element (68).

4. The device according to claim 3 wherein said plate body (30) is provided with a transversal cavity (71) in correspondence of said through opening (34) for the insertion and guide of said unhooking element (68) therein.

* * * * *